US006662667B2

(12) United States Patent
Kobayashi et al.

(10) Patent No.: US 6,662,667 B2
(45) Date of Patent: Dec. 16, 2003

(54) GOLF SHOES

(75) Inventors: Kazuhiko Kobayashi, Kobe (JP); Seigou Sakagami, Kobe (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 0 days.

(21) Appl. No.: 09/987,666

(22) Filed: Nov. 15, 2001

(65) Prior Publication Data

US 2002/0083625 A1 Jul. 4, 2002

(30) Foreign Application Priority Data

Nov. 15, 2000 (JP) ..... 2000-348621

(51) Int. Cl.[7] ..... G01N 3/20; A43B 5/00
(52) U.S. Cl. ..... 73/849; 36/127
(58) Field of Search ..... 73/849; 36/114, 36/25 R, 127, 102

(56) References Cited

U.S. PATENT DOCUMENTS 5,595,003 A * 1/1997 Snow ..... 36/28
6,029,374 A * 2/2000 Herr et al. ..... 36/27
6,516,541 B2 * 2/2003 Cagner ..... 36/102

FOREIGN PATENT DOCUMENTS

JP 6-17502 3/1994

* cited by examiner

*Primary Examiner*—Edward Lefkowitz
*Assistant Examiner*—Takisha S Miller
(74) *Attorney, Agent, or Firm*—Birch, Stewart, Kolasch & Birch, LLP.

(57) ABSTRACT

A golf shoe (1) comprises a sole portion (an outsole) (3) and an upper portion (5). The sole portion (3) is formed of an elastic material. The golf shoe (1) has a toe side flexibility evaluation value (Gt) of 0.0015 to 0.0100. The toe side flexibility evaluation value (Gt) is calculated by the following equation (I);

$$Gt=(20/L)/Ft \quad \text{(I)}$$

In the equation (I), L represents an overall length (mm) of the sole portion (3). Furthermore, Ft represents a tensile load (N) required for fixing a half part of the sole portion (3) close to a heel and pulling a front end close to a toe, thereby displacing the front end by 20 mm.

12 Claims, 4 Drawing Sheets

GOLF SHOES

BACKGROUND OF THE INVENTION

1. Field of the Invention

The present invention relates to golf shoes.

2. Description of the Related Art

Conventionally, golf shoes having a sole portion provided with a metal pin referred to as a spike pin have been in the mainstream. The spike pin sticks into the ground, thereby stabilizing the swing of a golf player. It is necessary to always maintain the spike pin perpendicularly to the ground surface and rocking is to be blocked during the swing. For this purpose, the sole portion is formed of a material having a high rigidity so that the spike pin is fixed firmly. In golf shoes, a clip plate for fixing the spike pin is to be buried in the sole portion. Therefore, the sole portion is much more rigid through the clip plate.

A large number of professional golf players and advanced amateur golf players (hereinafter referred to as "advanced golf players") swing a golf club by effectively utilizing the sole portion having a high rigidity. In the take-back, the golf player effectively utilizes the inside edge of the sole portion for a kicking foot (a right foot for a right-handed golf player), thereby preventing the sway of his (her) weight. In the early stage of a down-swing, moreover, the golf player effectively utilizes the inside edge of the sole portion of the kicking foot to kick the ground and to transmit the force to a golf club. In the latter half of the down-swing, furthermore, the golf player effectively utilizes the outside edge of the sole portion for a pivoting foot (a left foot for the right-handed golf player) to stabilize the pivoting foot.

In recent years, so-called spikeless shoes comprising a sole portion provided with a projection formed of an elastic material such as synthetic resin or rubber in place of a spike pin have spread and have been the mainstream of the golf shoes. In the spikeless shoes, it is not necessary to firmly fix a spike pin. Therefore, it is not necessary to form the sole portion with a material having a high rigidity. However, the advanced golf player masters a swing form suitable for the sole portion having a high rigidity. In order to smoothly exchange the golf shoes having a spike pin with the spikeless shoes, the sole portion having a high rigidity is exactly utilized in the spikeless shoes.

The sole portion having a high rigidity is bent with difficulty during walking. Accordingly, when a golf player wearing the golf shoes comprising the sole portion walks for a long time, the feet are easily tired. A large number of unadvanced golf players (most of amateur golf players are not advanced) have low swing speeds. Therefore, the sole portion having a high rigidity gives small advantages. Under the actual circumstances, a large number of amateur golf players desire golf shoes having more walking easiness than swing easiness, that is, golf shoes excellent in a bending properties.

Japanese Unexamined Utility Model Publication No. Hei 6-17502 (1994/17502) has disclosed golf shoes comprising a sole portion in which a groove is formed. In the golf shoes, the bending property of the sole portion is enhanced by the groove formed except for the vicinity of a spike pin.

Also in such golf shoes, however, a clip plate for fixing the spike pin is buried in the sole portion. Accordingly, the bending property of the sole portion is still insufficient. If the groove is formed extremely deeply, the bending property is wholly enhanced. In this case, however, there is a possibility that the stability of a swing might be damaged.

The present invention has been made in consideration of such actual circumstances and has an object to provide golf shoes which give walking easiness and less fatigue and contribute to the stability of a swing.

SUMMARY OF THE INVENTION

In order to attain the object, the present invention provides a golf shoe comprising a sole portion and an upper portion and having a toe side flexibility evaluation value (Gt) of 0.0015 to 0.0100.

The golf shoe has a proper bending property. Accordingly, the suppression of a fatigue and the stability of a swing during walking are consistent with each other.

The toe side flexibility evaluation value (Gt) is calculated by the following equation (I).

$$Gt=(20/L)/Ft \quad \text{(I)}$$

In the equation (I), L represents an overall length (mm) of the sole portion. Furthermore, Ft represents a tensile load (N) required for fixing a half part of the sole portion close to a heel and pulling a front end close to a toe, thereby displacing the front end by 20 mm.

It is preferable that a heel side flexibility evaluation value (Gh) should be 0.0020 to 0.0090. During walking, consequently, the fatigue can be more suppressed and the swing can be more stabilized.

The heel side flexibility evaluation value (Gh) is calculated by the following equation (II).

$$Gh=(20/L)/Fh \quad \text{(II)}$$

In the equation (II), L represents an overall length (mm) of the sole portion. Furthermore, Fh represents a tensile load (N) required for fixing a half part of the sole portion close to the toe and pulling a rear end close to the heel, thereby displacing the rear end by 20 mm.

It is preferable that a ratio (Gt/Gh) of the toe side flexibility evaluation value (Gt) to the heel side flexibility evaluation value (Gh) should be 0.4 to 1.4. Consequently, the swing can be stabilized still more. Furthermore, the bending pattern of the golf shoe approximates to the natural bending pattern of a human foot and the fatigue can be suppressed still more during walking.

The present invention is particularly suitable for a golf shoe in which a sole portion is not provided with a pin formed of metal or ceramics but is provided with a projection formed of an elastic material.

DESCRIPTION OF THE PREFERRED EMBBODIMENTS

The present invention will be described below in detail based on a preferred embodiment with reference to the drawings.

Figure 1:
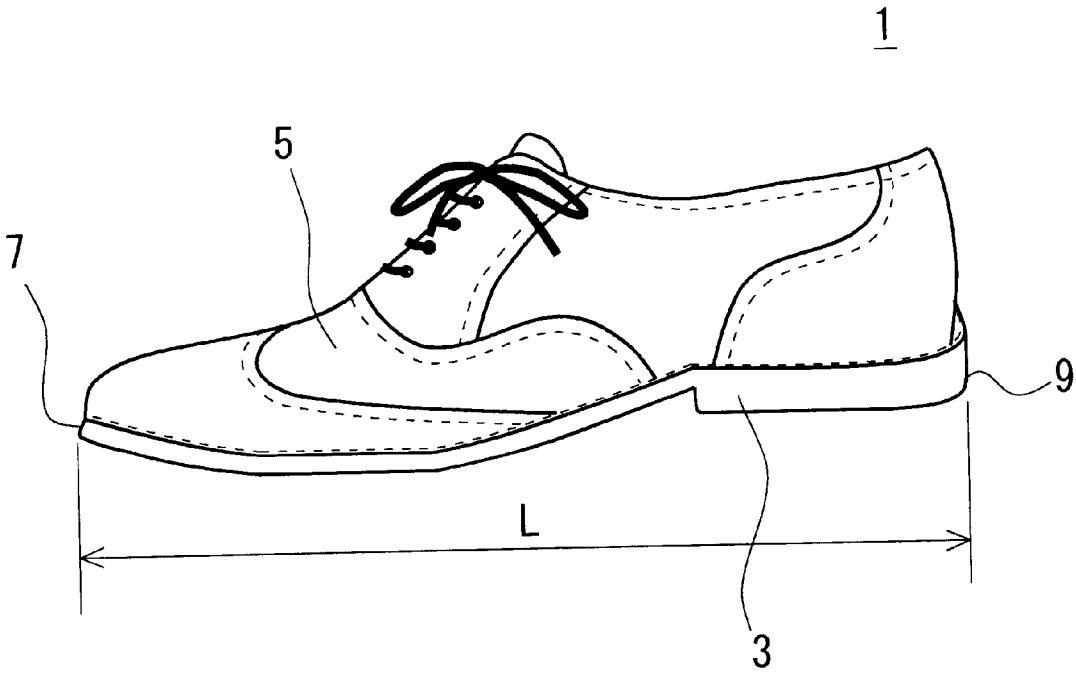
FIG. 1 is a side view showing golf shoes according to an embodiment of the present invention.

A golf shoe 1 shown in FIG. 1 comprises a sole portion (an outsole) 3 and an upper portion 5. The sole portion 3 is formed of an elastic material such as crosslinked rubber or synthetic resin. The sole portion 3 includes a large number of projections on a grounding surface, which is not shown. The projection may be formed integrally with the body of the sole portion 3 or may be formed separately from the body and attached to the body. The projection is also formed of an elastic material such as crosslinked rubber or synthetic resin. The upper portion 5 is formed of leather, artificial leather or the like. In FIG. 1, a narrow L indicates the overall length (mm) of the sole portion 3. The overall length L implies a length of the longest segment which can be drawn in the contour of the sole portion 3 seen from a bottom side. The overall length L is also a distance between a front end 7 of the sole portion 3 and a rear end 9 thereof.

Figure 2:
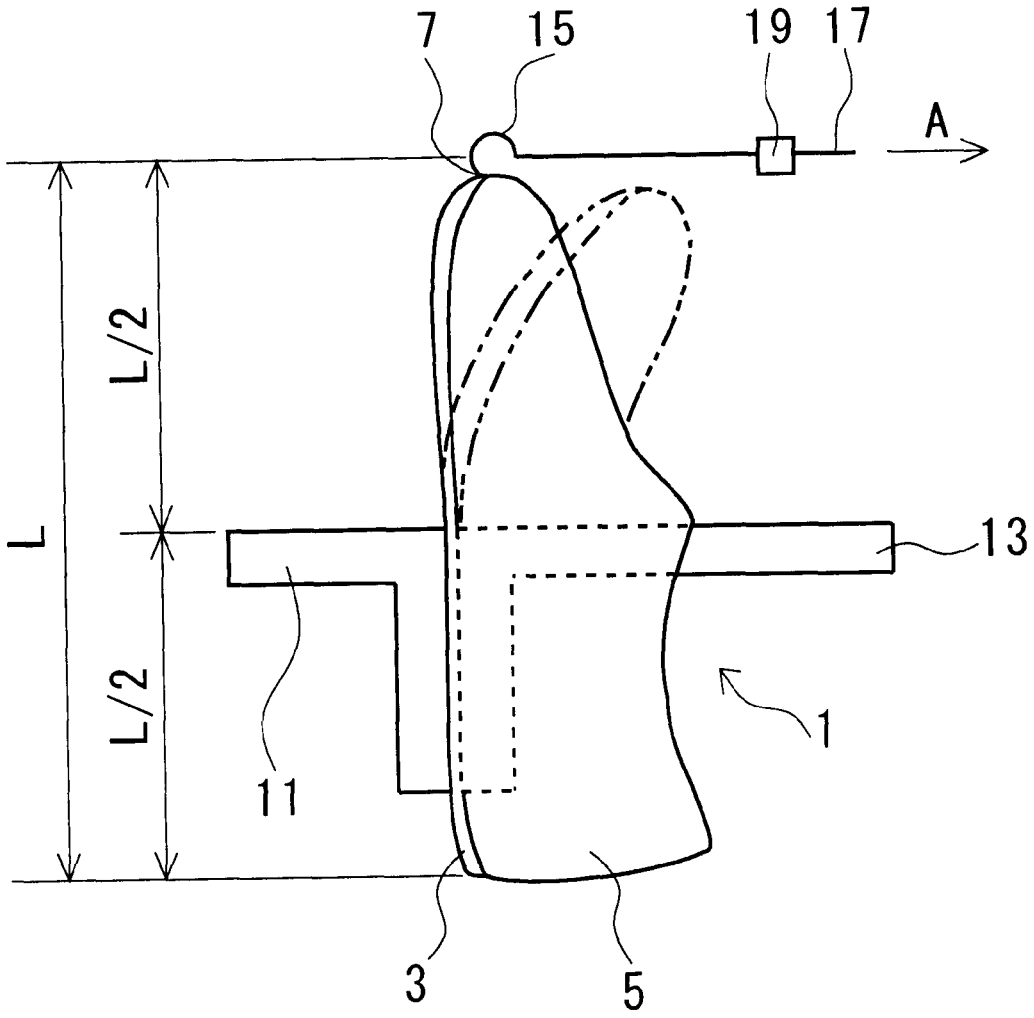
FIG. 2 is atypical view showing the state of the measurement of a toe side flexibility evaluation value (Gt) for the golf shoes of FIG. 1.

The golf shoe 1 has a toe side flexibility evaluation value (Gt) of 0.0015 to 0.0100. In the measurement of the toe side flexibility evaluation value (Gt), first of all, the golf shoe 1 is set such that the grounding surface is turned in a vertical direction and the front end 7 is turned upward as shown in FIG. 2. The sole portion 3 is held between a first holding plate 11 and a second holding plate 13. The upper surfaces of both holding plates 11 and 13 are positioned in the intermediate point of the overall length L. A half part of the sole portion 3 close to a heel is fixed by the holding plates 11 and 13 to prevent bending. A half part of the sole portion 3 close to a toe can be deformed together with the upper portion 5 corresponding to the same portion.

Next, a hook 15 is caught on the front end 7 of the sole portion 3. A wire 17 is coupled to the hook 15. A load meter 19 (for example, a load cell) is attached to the middle of the wire 17. The tip (a right end in FIG. 2) of the wire 17 is pulled in a direction shown in an arrow A (a horizontal direction, that is, a direction from the sole portion 3 toward the upper portion 5). Consequently, the golf shoe 1 is deformed and the front end 7 is displaced as shown in a virtual line (a two-dotted line) of FIG. 2. A tensile load (N) with the front end 7 having a displacement of 20 mm is measured by the load meter 19 and is represented by Ft. The Ft is substituted for the following equation (I) and the toe side flexibility evaluation value (Gt) is calculated.

$$Gt=(20/L)/Ft \quad \text{(I)}$$

The toe side flexibility evaluation value (Gt) is measured at a temperature of 23° C. and a relative humidity of 60%. The golf shoe 1 preserved for 5 hours or more in such a measurement environment is measured. In the case in which the golf shoe 1 comprises a removable projection, the toe side flexibility evaluation value (Gt) is measured in a practical use state, that is, a state in which the projection is attached.

(20/L) in the equation (I) represents a so-called bending ratio and Ft represents a load required for achieving the bending ratio. More specifically, the toe side flexibility evaluation value (Gt) is an index indicative of the bending easiness of the half part of the golf shoe 1 close to the toe. If the toe side flexibility evaluation value (Gt) is less than 0.0015, a fatigue caused by walking is not sufficiently suppressed in some cases. From this viewpoint, the toe side flexibility evaluation value (Gt) is more preferably 0.0020 or more, and particularly preferably 0.0030 or more. If the toe side flexibility evaluation value (Gt) is more than 0.0100, the stability of a swing is damaged in some cases. From this viewpoint, the tow side flexibility evaluation value (Gt) is more preferably 0.0090 or less, and particularly preferably 0.0080 or less.

Figure 3:
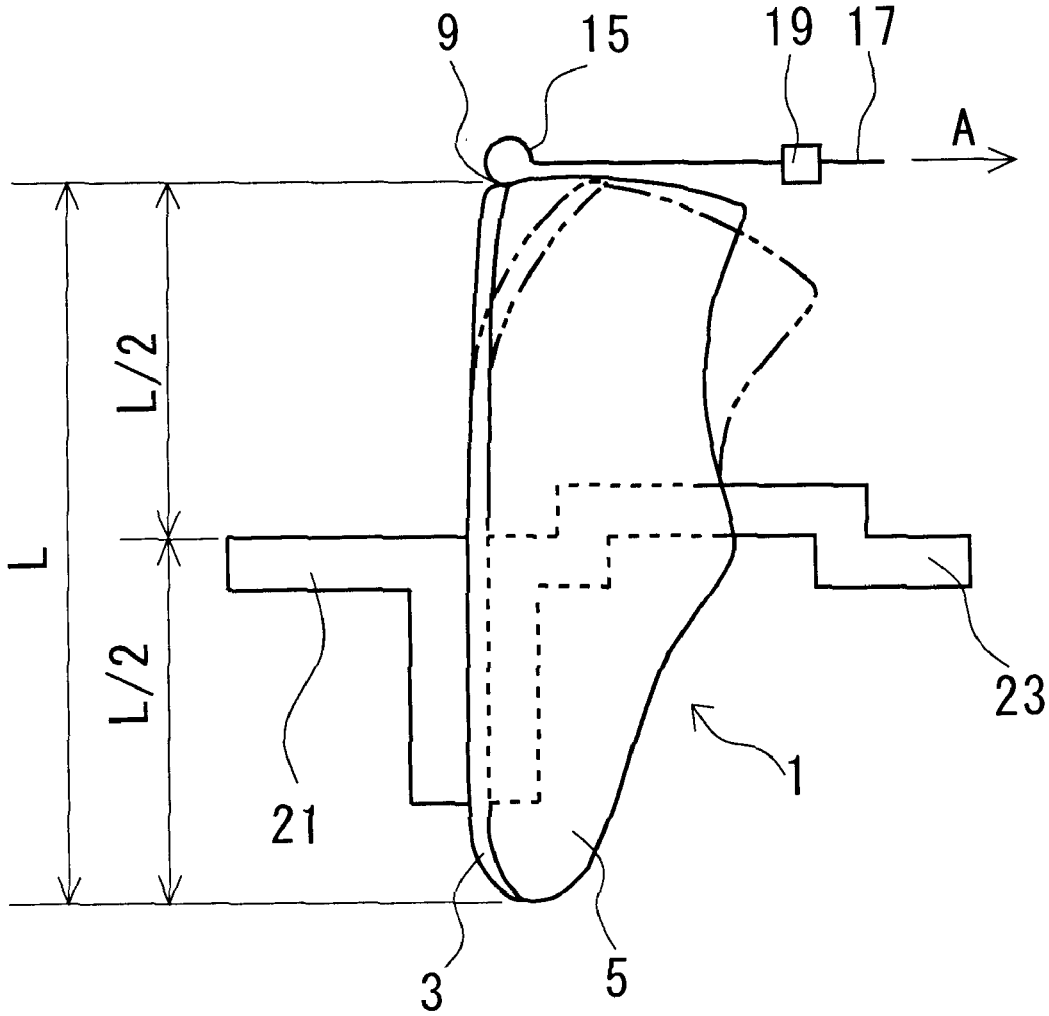
FIG. 3 is a typical view showing the state of the measurement of a heel side flexibility evaluation value (Gh) for the golf shoes of FIG. 1.

It is preferable that the heel side flexibility evaluation value (Gh) of the golf shoe 1 should be 0.0020 to 0.0090. In the measurement of the heel side flexibility evaluation value (Gh), first of all, the golf shoe 1 is set such that the grounding surface is turned in a vertical direction and the rear end 9 is turned upward as shown in FIG. 3. The sole portion 3 is held between a first holding plate 21 and a second holding plate 23. The upper surfaces of both holding plates 21 and 23 are positioned in the intermediate point of the overall length L. A half part of the sole portion 3 close to a toe is fixed by the holding plates 21 and 23 to prevent bending. A half part of the sole portion 3 close to a heel can be deformed together with the upper portion 5 corresponding to the same portion.

Next, the hook 15 is caught on the rear end 9 of the sole portion 3. The wire 17 is coupled to the hook 15. The load meter 19 is attached to the middle of the wire 17. The tip (a right end in FIG. 3) of the wire 17 is pulled in a direction shown in an arrow A (a horizontal direction, that is, a direction from the sole portion 3 toward the upper portion 5). Consequently, the golf shoe 1 is deformed and the rear end 9 is displaced as shown in a virtual line (a two-dotted line) of FIG. 3. A tensile load (N) with the rear end 9 having a displacement of 20 mm is measured by the load meter 19 and is represented by Fh. The Fh is substituted for the following equation (II) and the heel side flexibility evaluation value (Gh) is calculated.

$$Gh=(20/L)/Fh \quad \text{(II)}$$

The heel side flexibility evaluation value (Gh) is measured at a temperature of 23° C. and a relative humidity of 60%. The golf shoe 1 preserved for 5 hours or more in such a measurement environment is measured. In the case in which the golf shoe 1 comprises a removable projection, the heel side flexibility evaluation value (Gh) is measured in a practical use state, that is, a state in which the projection is attached.

(20/L) in the equation (II) represents a so-called bending ratio and Fh represents a load required for achieving the bending ratio. More specifically, the heel side flexibility evaluation value (Gh) is an index indicative of the bending easiness of the half part of the golf shoe 1 close to the heel. If the heel side flexibility evaluation value (Gh) is less than 0.0020, a fatigue caused by walking is not sufficiently suppressed in some cases. From this viewpoint, the heel side flexibility evaluation value (Gh) is more preferably 0.0025 or more, and particularly preferably 0.0028 or more. If the heel side flexibility evaluation value (Gh) is more than 0.0090, the stability of a swing is damaged in some cases. From this viewpoint, the heel side flexibility evaluation value (Gh) is more preferably 0.0080 or less, and particularly preferably 0.0060 or less.

The toe side flexibility evaluation value (Gt) and the heel side flexibility evaluation value (Gh) can be regulated by various means. For example, the flexibility evaluation values (Gt and Gh) are increased if the Young's modulus of the elastic material of the sole portion 3 is set to be great, and the flexibility evaluation values (Gt and Gh) are decreased if the Young's modulus is set to be small. If the thickness of the sole portion 3 is greater, the flexibility evaluation values (Gt and Gh) are increased. If the thickness of the sole portion 3 is smaller, the flexibility evaluation values (Gt and Gh) are decreased. By using a material having a high hardness for the upper portion 5, the flexibility evaluation values (Gt and Gh) are increased. By using a flexible material for the upper portion 5, the flexibility evaluation values (Gt and Gh) are decreased. By burying a shank in the sole portion 3, the flexibility evaluation values (Gt and Gh) are increased. By providing a large number of cuts on the sole portion 3, the flexibility evaluation values (Gt and Gh) are decreased. By separately setting the specification of the half part of the sole portion 3 close to the toe and the specification of the half part of the sole portion 3 close to the heel, the toe side flexibility evaluation value (Gt) and the heel side flexibility evaluation value (Gh) can be regulated separately.

It is preferable that a ratio (Gt/Gh) of the toe side flexibility evaluation value (Gt) to the heel side flexibility evaluation value (Gh) in the golf shoe 1 should be 0.4 to 1.4. If the ratio is less than 0.4, the bending pattern of the golf shoe deviates from the natural bending pattern of a human foot and the golf player easily feels fatigued during walking. From this viewpoint, the ratio is more preferably 0.45 or more, and particularly preferably 0.8 or more. If the ratio is more than 1.4, the stability of the sole portion 3 close to the heel is damaged to hinder a swing in some cases. From this viewpoint, the ratio is more preferably 1.3 or less, and particularly preferably 1.2 or less.

The projection of the sole portion 3 may be formed in any pattern. In consideration of a difference in a role between right and left feet in the swing, the projection pattern of the golf shoe 1 for the right foot may be asymmetrical with the projection pattern of the golf shoe 1 for the left foot. Consequently, even an advanced golf player having a high swing speed can use the golf shoe 1 according to the present invention with fitness. In place of the projection or together with the projection, a pin formed of metal or ceramics may be provided. In order to prevent the sole portion 3 from being very rigid due to a clip plate for fixing the pin, however, it is preferable that only a projection formed of an elastic material should be provided in the sole portion 3.

EXAMPLES

Example 1

Figure 4:
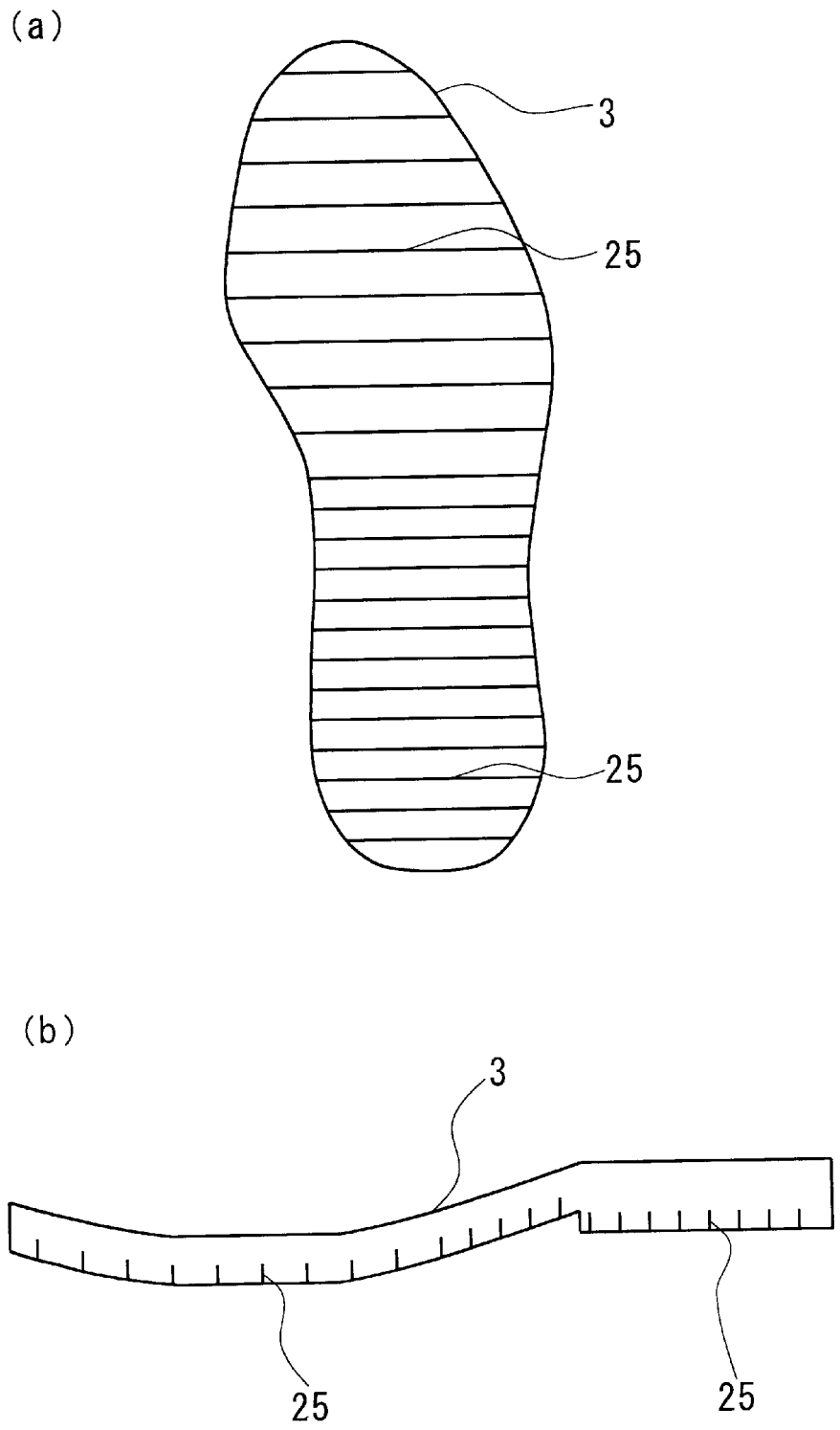
FIG. 4 is a typical view showing golf shoes according to an example of the present invention.

A golf shoe put on the market (trade name "DUNLOP S-3233" produced by Sumitomo Rubber Industries, Ltd.) was prepared. The upper portion of the golf shoe is formed of water repellent finished leather and a sole portion 3 is formed of crosslinked rubber. The golf shoe comprises a shank. The sole portion 3 has an overall length L of 285 mm. A cut 25 extended in a transverse direction as shown in FIG. 4 was formed on the sole portion 3 by means of a cutter knife. The depth of the cut 25 was set to 3 mm. An interval between the cuts 25 and 25 in a half part close to a toe was set to 10 mm. Moreover, an interval between the cuts 25 and 25 in a half part close to a heel was set to 8 mm. Thus, a golf shoe according to an example 1 was obtained.

Examples 2 to 4 and Comparative Example 1

A golf shoe according to each of examples 2 to 4 and a comparative example 1 was obtained in the same manner as in the example 1 except that an interval between cuts in the half part of a sole portion 3 close to a toe and an interval between cuts in the half part of the sole portion 3 close to a heel were set as shown in the following Table 1.

Comparative Example 2

A golf shoe according to a comparative example 2 was obtained in the same manner as in the example 1 except that an interval between cuts in the half part of a sole portion 3 close to a heel was set as shown in the following Table 1 and a cut was not formed in a half part close to a toe.

[Practical Test]

Ten golf players wore golf shoes and played a golf on a golf course. A land having three holes was carried out for each golf shoe, and walking easiness and stability during a swing were evaluated in five stages of "1" to "5". For the walking easiness, the least walking easiness was evaluated as "1"and the most walking easiness was evaluated as "5". For the stability, the least stability was evaluated as "1" and the most stability was evaluated as "5". A mean evaluation value for the ten golf players is shown in the following Table 1.

TABLE 1

| | | Result of evaluation of golf shoe | | | | | |
|---|---|---|---|---|---|---|---|
| | | Example1 | Example2 | Example3 | Example4 | Com. Ex. 1 | Com. Ex. 2 |
| Total length L (mm) | | 285 | 285 | 285 | 285 | 285 | 285 |
| Toe side | Cut interval (mm) | 10 | 7 | 5 | 3 | 1 | — |
| | Tensile load Ft (N) | 45.0 | 22.9 | 13.8 | 9.8 | 6.0 | 73.0 |
| | Flexibility evaluation value Gt ($\times 10^{-5}$) | 156 | 300 | 510 | 720 | 1170 | 100 |
| Heel side | Cut interval | 8 | 6 | 5 | 3 | 1 | 15 |
| | Tensile load Fh (N) | 37.0 | 22.9 | 15.1 | 11.7 | 7.5 | 60.0 |
| | Flexibility evaluation value Gh ($\times 10^{-5}$) | 190 | 300 | 460 | 600 | 940 | 120 |
| (Gt/Gh) | | 0.82 | 1.00 | 1.11 | 1.20 | 1.24 | 0.83 |
| Walking easiness | | 3 | 5 | 5 | 5 | 5 | 1 |
| Stability | | 5 | 5 | 4 | 4 | 1 | 5 |

From the results of evaluation in the Table 1, the following is apparent. First of all, in the golf shoe according to the comparative example 1 in which the toe side flexibility evaluation value (Gt) is too great, stability can be obtained with difficulty during a swing. In the golf shoe according to the comparative example 2 in which the toe side flexibility evaluation value (Gt) is too small, walking is not easy. On the other hand, the golf shoe according to each example gives walking easiness and excellent stability. By the evaluation, the advantage of the present invention is apparent.

The above description is only illustrative and various change scan be made without departing from the scope of the present invention.

What is claimed is:

1. a. A golf shoe comprising a sole portion and an upper portion, wherein a toe side flexibility evaluation value (Gt) is 0.0015 to 0.0100, which is calculated by an equation (I)

$$Gt=(20/L)/Ft \quad \text{(I)}$$

Wherein, L represents an overall length (mm) of the sole portion and Ft represents a tensile load (N) required for fixing a half part of the sole portion close to a heel and pulling a front end close to a toe, thereby displacing the front end by 20 mm.

2. b. The golf shoe according to claim 1, wherein a heel side flexibility evaluation value (Gh) is 0.0020 to 0.0090, which is calculated by an equation (II);

$$Gh=(20/L)/Fh \quad \text{(II)}$$

Wherein, L represents an overall length (mm) of the sole portion and Fh represents a tensile load (N) required for fixing a half part of the sole portion close to the toe and pulling a rear end close to the heel, thereby displacing the rear end by 20 mm).

3. The golf shoe according to claim 2, wherein a ratio (Gt/Gh) of the toe side flexibility evaluation value (Gt) to the heel side flexibility evaluation value (Gh) is 0.4 to 1.4.

4. The golf shoe according to claim 1, wherein the sole portion is provided with a projection formed of an elastic material.

5. The golf shoe according to claim 1, wherein the toe side flexibility evaluation value (Gt) is 0.0020 to 0.0090.

6. The golf shoe according to claim 1, wherein the toe side flexibility evaluation value (Gt) is 0.0030 to 0.0090.

7. The golf shoe according to claim 1, wherein the toe side flexibility evaluation value (Gt) is 0.0020 to 0.0080.

8. The golf shoe according to claim 1, wherein the toe side flexibility evaluation value (Gt) is 0.0030 to 0.0080.

9. The golf shoe according to claim 1, wherein the heel side flexibility evaluation value (Gh) is 0.0025 to 0.0080.

10. The golf shoe according to claim 1, wherein the heel side flexibility evaluation value (Gh) is 0.0028 to 0.0080.

11. The golf shoe according to claim 1, wherein the heel side flexibility evaluation value (Gh) is 0.0025 to 0.0060.

12. The golf shoe according to claim 1, wherein the heel side flexibility evaluation value (Gh) is 0.0028 to 0.0060.

* * * * *